US006431162B1

(12) United States Patent
Mizek et al.

(10) Patent No.: US 6,431,162 B1
(45) Date of Patent: Aug. 13, 2002

(54) ARCHERY QUIVER FOR HOLDING A BROADHEAD

(75) Inventors: Robert S. Mizek, Downers Grove; Miroslav A. Simo, Riverside, both of IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 09/687,438

(22) Filed: Oct. 13, 2000

(51) Int. Cl.[7] ..... F41B 5/06
(52) U.S. Cl. ..... 124/86; 124/25.5; 224/916
(58) Field of Search ..... 124/25.5, 25.7, 124/86, 88; 224/916

(56) References Cited

U.S. PATENT DOCUMENTS

| | | | | |
|---|---|---|---|---|
| 3,110,336 | A | * | 11/1963 | Sukala |
| 3,337,099 | A | * | 8/1967 | Rose |
| 3,465,928 | A | * | 9/1969 | Osterholm |
| 4,073,328 | A | | 2/1978 | Franklin |
| D248,040 | S | | 5/1978 | Stinson |
| 4,156,496 | A | | 5/1979 | Stinson |
| 4,247,027 | A | | 1/1981 | Tardiff |
| 4,252,101 | A | | 2/1981 | Spitzke |
| 4,363,312 | A | | 12/1982 | Spitzke |
| 4,522,187 | A | | 6/1985 | Tafel |
| 4,995,372 | A | | 2/1991 | Topel ..... 124/25.5 |
| D331,319 | S | | 12/1992 | Stinson |
| 5,190,022 | A | | 3/1993 | Larson ..... 124/25.7 |
| 5,265,584 | A | | 11/1993 | Judson et al. ..... 124/86 |
| 5,452,703 | A | | 9/1995 | Bateman, III ..... 124/86 |
| 5,803,069 | A | | 9/1998 | Schreiber ..... 124/86 |
| 6,006,734 | A | | 12/1999 | Sodaro ..... 124/86 |

OTHER PUBLICATIONS p. 1 of 9 through p. 9 of 9, which includes advertisements from various catalogs.

* cited by examiner

*Primary Examiner*—John A. Ricci
(74) *Attorney, Agent, or Firm*—Pauley Petersen Kinne & Erickson

(57) ABSTRACT

An archery quiver, for holding a broadhead, having a support structure with at least one mounting bore and an insert positionable within each mounting bore. The insert has a plurality of arms which extend radially outward from a center portion of the insert, each arm forming a void for housing a blade of the broadhead. When the broadhead is in an inserted position within the insert, a plurality of areas of an inner surface of the insert preferably contact a portion of at least one of a ferrule of the broadhead and an arrow shaft attached to the broadhead to securely center the broadhead within the insert.

20 Claims, 3 Drawing Sheets

ARCHERY QUIVER FOR HOLDING A BROADHEAD

BACKGROUND OF THE INVENTION

1. Field of the Invention

This invention relates to an archery quiver, for holding a broadhead, having a support structure with at least one mounting bore and an insert which is positionable within one or more mounting bores. An inner surface of the insert securely centers the broadhead within the insert for safety reasons and to prevent damage to the blades of the broadhead.

2. Description of Related Art

An archery quiver is used by a hunter to safely transport arrows while hunting. Conventional archery quivers include a quiver hood or shell which covers the broadheads and protects both the hunter from the broadheads and the broadheads from hunting or other environments. The arrows attached to the broadheads are typically secured for transport with an arrow spreader mounted to a bow with a quiver mounting bracket. Typically, there is no structure of the hood that holds the broadheads within a void formed by the hood and the broadheads may undesirably contact an inner wall of the hood and/or adjacent broadheads, resulting in damage to the broadhead blades. In some conventional archery quivers, to better secure the arrows and prevent damage to the broadheads, a second arrow spreader is mounted near the broadhead. However, the second arrow spreader interferes with the broadhead during insertion and withdrawal of the broadhead.

Other conventional archery quivers may have a hood which is lined or filled with a foam material into which broadheads are inserted to prevent contact between the broadhead and the inner wall of the hood and/or adjacent broadheads. However, the foam material dulls the blades as the broadhead is inserted and withdrawn from the hood and is easily damaged, for example torn and/or cut, as a result of the broadhead insertion and withdrawal. Also, the mechanical broadheads may open as they are inserted into the foam material.

Other conventional archery quivers have hoods which secure a tip portion of each broadhead. However, such archery quivers are dangerous, allowing the broadhead to easily release, risking injury to the hunter and damage to the broadhead. Many conventional archery quivers are unsafe and provide little or no protection for the broadheads.

There is an apparent need for an archery quiver which securely holds each broadhead within the quiver hood during transport to prevent injury to the hunter and/or damage to the broadhead.

SUMMARY OF THE INVENTION

It is an object of this invention to provide an archery quiver having at least one insert positionable within a support structure to securely hold at least one broadhead.

It is another object of this invention to provide an archery quiver having a support structure which is easily fabricated to accommodate any number of inserts for holding different broadhead types, sizes and numbers.

It is another object of this invention to provide an archery quiver having at least one insert each with at least two arms for housing at least one broadhead with a corresponding number of blades, to provide safety and to prevent blade damage.

It is yet another object of this invention to provide an archery quiver having an insert with a plurality of areas on an inner surface of the insert which contact at least a portion of a ferrule of a broadhead and/or an arrow shaft attached to the broadhead, to hold and center the broadhead within the insert when the broadhead is in an inserted position.

The above and other objects of this invention are accomplished with an archery quiver, for holding a broadhead, having a support structure with at least one mounting bore. The mounting bore has dimensions which correspond to the dimensions of an insert, which is integrated with the support structure or removably positioned within each mounting bore, to mount or fix the insert with respect to the support structure, in a proper position within the corresponding mounting bore. Preferably, the support structure is made of a foam material, which provides manufacturing versatility and cost economy.

The insert has at least two arms which extend radially outward from a center portion of the insert. For example, to accommodate a three-blade broadhead, the insert has three arms which extend radially outward from the center portion of the insert and are positioned in a circumferential relation with respect to the center portion to accommodate the three-blade broadhead. More or less than three arms can be positioned about the center portion to house a broadhead having more or less than three blades.

In one embodiment of this invention, each arm forms a void for accepting and housing a blade of the broadhead. Preferably, each void has dimensions which are greater than the corresponding dimensions of the broadhead blade housed within the void so that the broadhead blade can be easily inserted and withdrawn, and to protect each blade from undesired contact with an inner surface of the insert. Such contact may dull and/or damage the broadhead blade. Further, the insert protects the broadhead blade from undesired contact with the foam support structure. In one embodiment of this invention, each void forms a channel which houses one corresponding blade of the broadhead.

In one embodiment of this invention, the inner surface of each insert has a plurality of areas which contact a portion of a ferrule of the broadhead and/or an arrow shaft attached to the broadhead. For example, the inner surface of the insert may have three areas which contact a portion of the ferrule and/or the arrow shaft when the broadhead is in an inserted position within the insert. With the broadhead in the inserted position, the areas of the insert contact a portion of the ferrule and/or the arrow shaft to secure and center the broadhead within the insert. An end wall of the insert can form an aperture which accommodates a tip of the broadhead. The tip may or may not extend through the aperture beyond a back surface of the end wall.

Preferably, the insert is made or molded from a suitable material which is deformable and/or expandable to accept the broadhead and resilient to apply sufficient pressure to the ferrule of the broadhead and/or the arrow shaft at the contact areas, for example to securely hold the broadhead centered within the insert.

A back plate may be attached to or positioned adjacent an end surface of the support structure. Preferably, but not necessary, the end surface is made of a foam material, the same or similar to the support structure material, and is positioned within the quiver hood to protect arrow tips from undesired contact with the quiver hood.

BRIEF DESCRIPTION OF THE DRAWINGS

The drawings show different features of an archery quiver according to preferred embodiments of this invention, wherein.

DETAILED DESCRIPTION OF PREFERRED EMBODIMENTS

Figure 1:
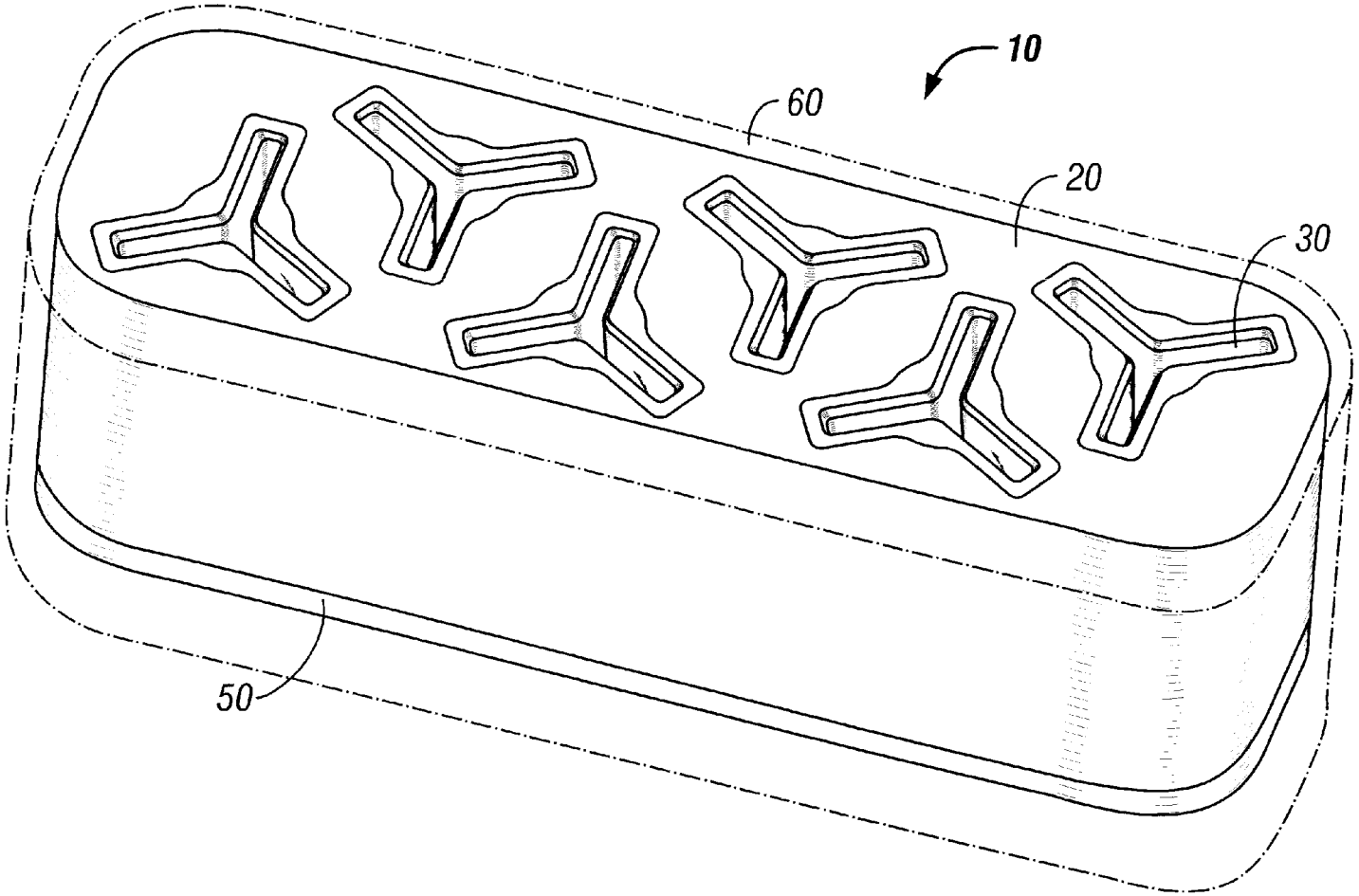
FIG. 1 is a perspective side view of a support structure with a plurality of mounting bores, and an insert positioned within each mounting bore, according to one preferred embodiment of this invention.
Figure 2:
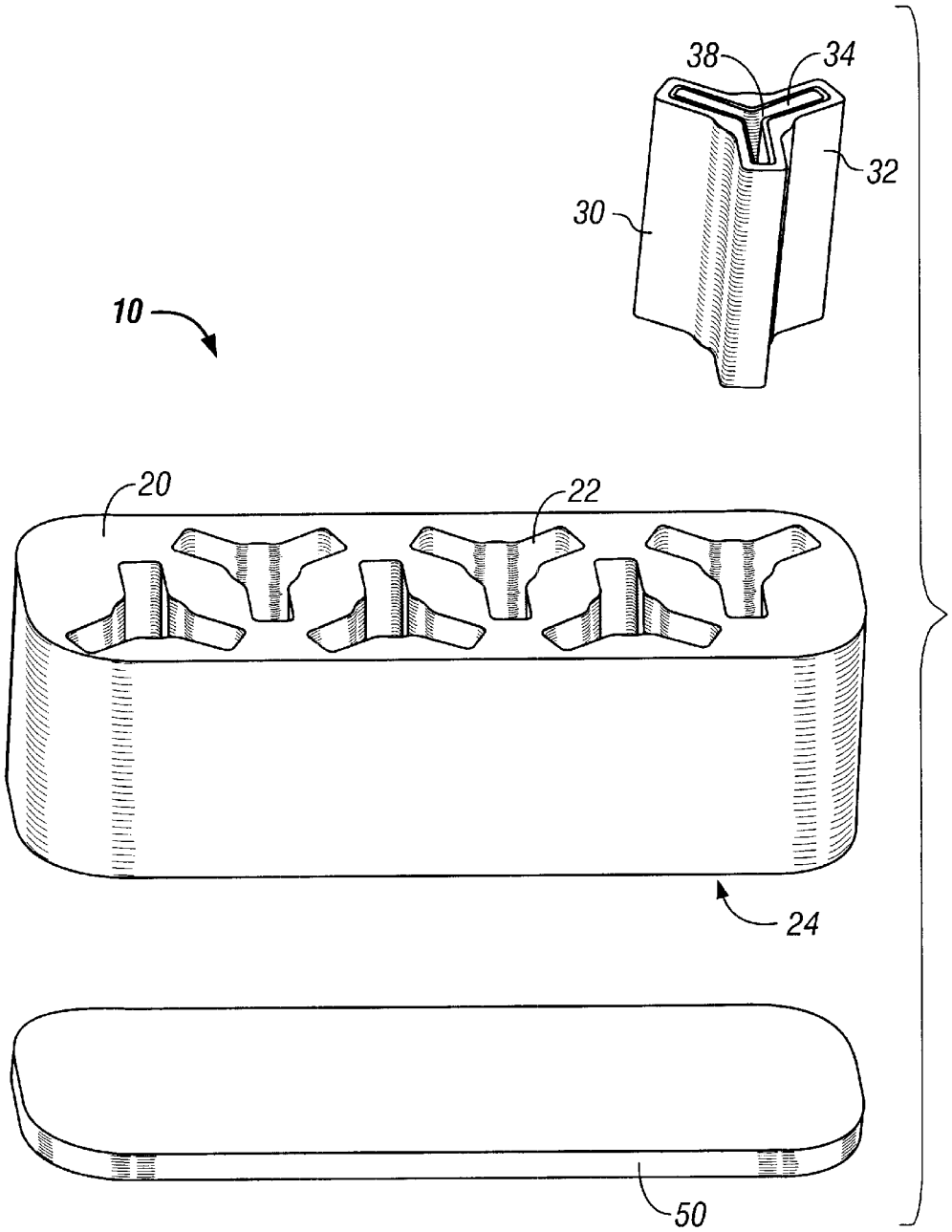
FIG. 2 is an exploded perspective side view of a support structure having a plurality of mounting bores, an insert and a back plate, according to one preferred embodiment of this invention.

Referring to FIGS. 1 and 2, an archery quiver 10, for holding a broadhead, comprises a support structure 20 having at least one mounting bore 22. Archery quiver 10 according to this invention is suitable for holding many conventional broadheads having different sizes, shapes and/or number of blades, including mechanical broadheads which have blades that open upon impact. Preferably, but not necessarily, support structure 20 comprises a plurality of mounting bores 22. For example, six mounting bores 22 are shown in FIGS. 1 and 2. It is apparent that more or less than six mounting bores 22 can be positioned within support structure 20. Preferably, mounting bore 22 has dimensions which correspond to external dimensions of an insert 30, which is positionable within each mounting bore 22, to hold insert 30 in a proper position within mounting bore 22, as shown in FIG. 2.

In one preferred embodiment of this invention, support structure 20 is made of a suitable foam material that provides manufacturing and assembly versatility and cost economy. Support structure 20 of a foam material is easily fabricated and/or designed to accommodate different numbers of inserts 30 and/or inserts 30 having different configurations or sizes. Any suitable material may be used to fabricate support structure 20 which securely holds insert 30 within each mounting bore 22 and which can be easily inserted or mounted within a quiver hood 60, as shown in FIG. 1.

Figure 3:
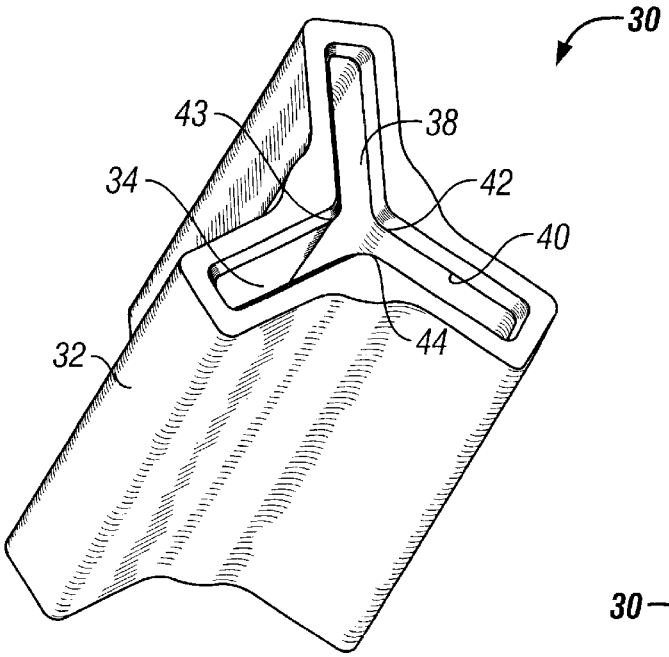
FIG. 3 is a perspective front view of an insert of an archery quiver, according to one preferred embodiment of this invention.
Figure 4:
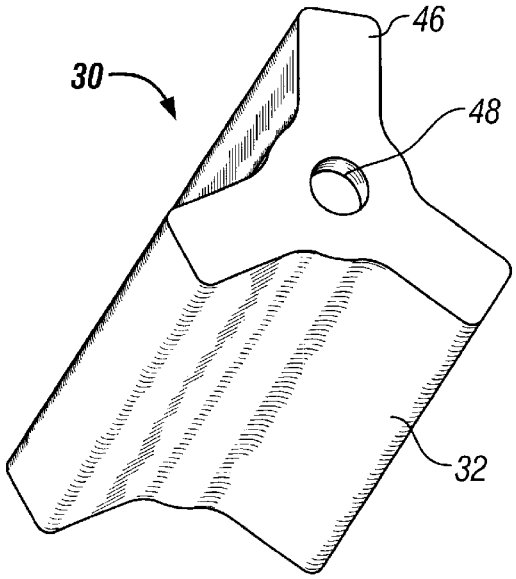
FIG. 4 is a perspective rear view of an insert of an archery quiver, according to one preferred embodiment of this invention.

Insert 30 comprises at least two arms 32 which extend radially outward from a center portion 38 of insert 30. As shown in FIGS. 3 and 4, three arms 32 extend radially outward from center portion 38 and are positioned in a circumferential relation with respect to center portion 38. In one preferred embodiment of this invention, three arms 32 are equally spaced about the circumference of center portion 38. As shown in FIGS. 1–5, each arm 32 is positioned about 120° from each of the two other arms 32. It is apparent that more or less than three arms 32 can be positioned about center portion 38, for example to house a broadhead having 2, 3, 4 or 5 blades.

In one preferred embodiment of this invention, each arm 32 forms a void 34 for accepting and housing one corresponding blade of the broadhead. In one embodiment of this invention, each void 34 forms a channel for housing one corresponding blade of the broadhead. Preferably, each void 34 has a length, a height and a width which is greater than a length, a height and a width, respectively, of the corresponding broadhead blade housed within void 34. It is preferred that the dimensions of each void 34 are greater than the corresponding dimensions of the broadhead blade to protect each blade from undesired contact with an inner surface 40 of insert 30 when the broadhead is in an inserted position. Such contact may dull and/or damage the broadhead blade. Further, insert 30 protects each broadhead blade from undesired contact with support structure 20.

Figure 5:
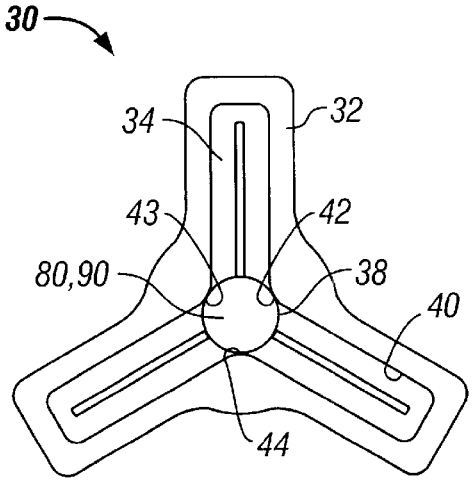
FIG. 5 is a top view of an insert of an archery quiver, according to one preferred embodiment of this invention.

As shown in FIGS. 3 and 5, each insert 30 has inner surface 40 having a plurality of areas which contact at least a portion of the ferrule 80 and/or the arrow shaft 90. For example, in one preferred embodiment of this invention as shown in FIGS. 3 and 5, inner surface 40 of insert 30 has at least three areas 42, 43 and 44 which contact a portion of the ferrule 80 and/or the arrow shaft 90 when the broadhead is in an inserted position within insert 30. Areas 42, 43 and/or 44 extend along at least a portion of a length of insert 30. With the broadhead in the inserted position, areas 42, 43 and 44 contact a portion of the ferrule 80 and/or the arrow shaft 90 to secure and center the broadhead within insert 30. In this preferred embodiment of this invention, the three areas 42, 43 and 44 of contact allow the broadhead to be securely centered within insert 30. Preferably, but not necessarily, an end wall 46 of insert 30 forms an aperture 48 which accommodates a tip of the broadhead. The tip may or may not extend through aperture 48 and beyond end wall 46.

In one preferred embodiment of this invention, insert 30 is made or molded from a suitable synthetic or natural rubber or other polymeric material which is preferably deformable and/or expandable to accept the broadhead and resilient to apply sufficient bias force or pressure to the ferrule 80 and/or the arrow shaft 90 at areas 42, 43 and 44 to securely hold the broadhead centered within insert 30. Other suitable materials may be used to make or mold insert 30 having the desired properties.

Preferably, but not necessarily, a back plate 50 is attached to or contacts an end surface 24 of support structure 20, as shown in FIGS. 1 and 2. Preferably, but not necessarily, end surface 24 is made of a foam material, the same or similar to support structure 20, and is positioned within the quiver hood 60 to protect arrow tips from undesired contact with the quiver hood 60. It is apparent to those skilled in the art that any suitable material may be used to construct back plate 50 for this purpose.

In one preferred embodiment of this invention, one or more inserts 30 are integrated with or molded as a part of support structure 20. Also, a plurality of inserts 30 can be structurally connected, for example with a bridge element, and fixed with respect to each other. A structurally connected set of inserts 30 can be quickly mounted, with one movement, in a corresponding plurality of voids 34.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. An archery quiver for holding a broadhead comprising:

a support structure having at least one mounting bore; and an insert positionable within the at least one mounting bore, the insert having at least two arms extending radially outward from a center portion of the insert, each of the arms forming a void for receiving a blade of the broadhead, and a plurality of areas of an inner surface of the insert adapted to contact at least a portion of at least one of a ferrule of the broadhead and an arrow shaft attached to the broadhead.

2. An archery quiver according to claim 1 wherein the support structure comprises a foam material.

3. An archery quiver according to claim 1 wherein the support structure is mounted within a quiver hood.

4. An archery quiver according to claim 1 wherein the support structure has a plurality of mounting bores.

5. An archery quiver according to claim 1 wherein the insert comprises a deformable material.

6. An archery quiver according to claim 1 wherein an end wall of the insert forms an aperture.

7. An archery quiver according to claim 1 wherein the arms are equally spaced around a circumference of the center portion.

8. An archery quiver according to claim 1 wherein the at least one mounting bore is adapted to center a broadhead mounted within the insert.

9. An archery quiver according to claim 1 wherein the insert has three arms.

10. An archery quiver according to claim 9 wherein at least three of the areas of the inner surface of the insert are adapted to contact the portion of the at least one of the ferrule and the arrow shaft.

11. An archery quiver according to claim 1 further comprising a back plate contacting an end surface of the support structure.

12. An archery quiver according to claim 11 wherein the back plate comprises a foam material.

13. An archery quiver according to claim 1 wherein the insert is integrated with the support structure.

14. An archery quiver for holding a broadhead comprising:

a foam support structure having a plurality of mounting bores;

a resilient insert positionable within one of the mounting bores, the insert having a plurality of arms extending radially outward from a center portion of the insert, each of the arms forming a void for housing a blade of the broadhead; and at least three areas of an inner surface of the insert adapted to contact a portion of at least one of a ferrule of the broadhead and an arrow shaft attached to the broadhead.

15. An archery quiver according to claim 14 further comprising a foam back plate attached to an end surface of the foam support structure.

16. An archery quiver according to claim 14 wherein each of the voids has a void height greater than a blade height of a corresponding blade of the broadhead housed within the void.

17. An archery quiver according to claim 14 wherein each of the voids has a void width greater than a blade width of a corresponding blade of the broadhead housed within the void.

18. An archery quiver for holding a broadhead comprising:

a support structure, at least one insert attached to the support structure, the at least one insert having a plurality of arms extending radially outward from a center portion of the at least one insert, each of the arms forming a void for housing a blade of the broadhead, and a plurality of areas of an inner surface of the insert adapted to contact a portion of at least one of a ferrule of the broadhead and an arrow shaft attached to the broadhead.

19. An archery quiver according to claim 18 wherein the at least one insert is integrated with the support structure.

20. An archery quiver according to claim 19 wherein a plurality of the inserts are structurally connected to each other.

* * * * *